US011517118B2

(12) United States Patent
Pearson

(10) Patent No.: US 11,517,118 B2
(45) Date of Patent: Dec. 6, 2022

(54) SYSTEM AND METHOD FOR A SPRING MECHANISM FOR A WALL BED

(71) Applicant: John Pearson, Surprise, AZ (US)

(72) Inventor: John Pearson, Surprise, AZ (US)

( * ) Notice: Subject to any disclaimer, the term of this patent is extended or adjusted under 35 U.S.C. 154(b) by 0 days.

(21) Appl. No.: 17/474,968

(22) Filed: Sep. 14, 2021

(65) Prior Publication Data

US 2022/0079348 A1 Mar. 17, 2022

Related U.S. Application Data

(60) Provisional application No. 63/078,069, filed on Sep. 14, 2020.

(51) Int. Cl.

| | |
|---|---|
| ***A47C 17/40*** | (2006.01) |
| ***A47C 17/52*** | (2006.01) |
| ***A47C 17/38*** | (2006.01) |

(52) U.S. Cl.

CPC ..... *A47C 17/40* (2013.01); *A47C 17/52* (2013.01); *A47C 17/38* (2013.01)

(58) Field of Classification Search

CPC ..... A47C 17/40; A47C 17/38; A47C 17/48; A47C 17/52

USPC ..... 5/164.1, 166.1, 131, 133, 136, 159.1

See application file for complete search history.

(56) References Cited

U.S. PATENT DOCUMENTS

| | | | | |
|---|---|---|---|---|
| 5,978,988 | A * | 11/1999 | Burchett | A47C 17/40 5/164.1 |
| 6,105,185 | A * | 8/2000 | DiRocco | A47C 17/40 5/164.1 |
| 8,850,637 | B1 * | 10/2014 | Burchett | A47C 17/52 5/164.1 |
| 8,898,831 | B1 * | 12/2014 | Burchett | A47C 17/52 5/164.1 |
| 2014/0352059 | A1 * | 12/2014 | Burchett | A47C 17/52 5/164.1 |
| 2022/0079348 | A1 * | 3/2022 | Pearson | A47C 17/40 |

* cited by examiner

*Primary Examiner* — Robert G Santos
(74) *Attorney, Agent, or Firm* — Polsinelli PC

(57) ABSTRACT

Various embodiments of a spring mechanism for a wall bed having a bed frame pivotally mounted to a vertically-oriented stationary cabinet in which a piston rod and compression spring are operatively engaged to a lever arm at one of a plurality of coupling portions for setting a particular compressive spring force to be applied by the compression spring which is tailored to the specific weight of the pivoting bed frame being deployed or retracted are disclosed.

15 Claims, 18 Drawing Sheets

SYSTEM AND METHOD FOR A SPRING MECHANISM FOR A WALL BED

CROSS-REFERENCE TO RELATED APPLICATIONS

This is a non-provisional application that claims benefit to U.S. provisional application Ser. No. 63/078,069 filed on Sep. 14, 2020, which is herein incorporated by reference in its entirety.

FIELD

The present disclosure generally relates to a spring mechanism; for retaining, deploying and retracting a wall bed; and in particular, to systems and methods for a spring mechanism having an adjustable compression spring arrangement.

BACKGROUND

Wall beds are well known in the industry. Typically used to conserve living space, wall beds may be mounted to or within a wall using vertically mounted cabinet pivotally coupled to a bed frame by a pair of spring mechanisms that gradually deploy and retract the bed frame relative to the mounted cabinet. Many of the conventional spring mechanisms are single spring arrangements that are configured to gradually deploy and retract the bed frame when either pulled downward during deployment of the bed frame from the cabinet or pulled upward during retraction of the bed frame back into the cabinet in a recessed state by a user. However, such single spring arrangements for spring mechanisms can experience structural fatigue after repeated deployment and retraction of the wall frame over time which can lead to ineffective deployment and/or retraction of the bed frame by such fatigued spring mechanisms. In addition, conventional wall beds lack a means for manually adjusting the degree of tension or compression spring force applied to the bed frame during deployment and retraction to accommodate different types of mattresses and bed springs of varying weight.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 2:
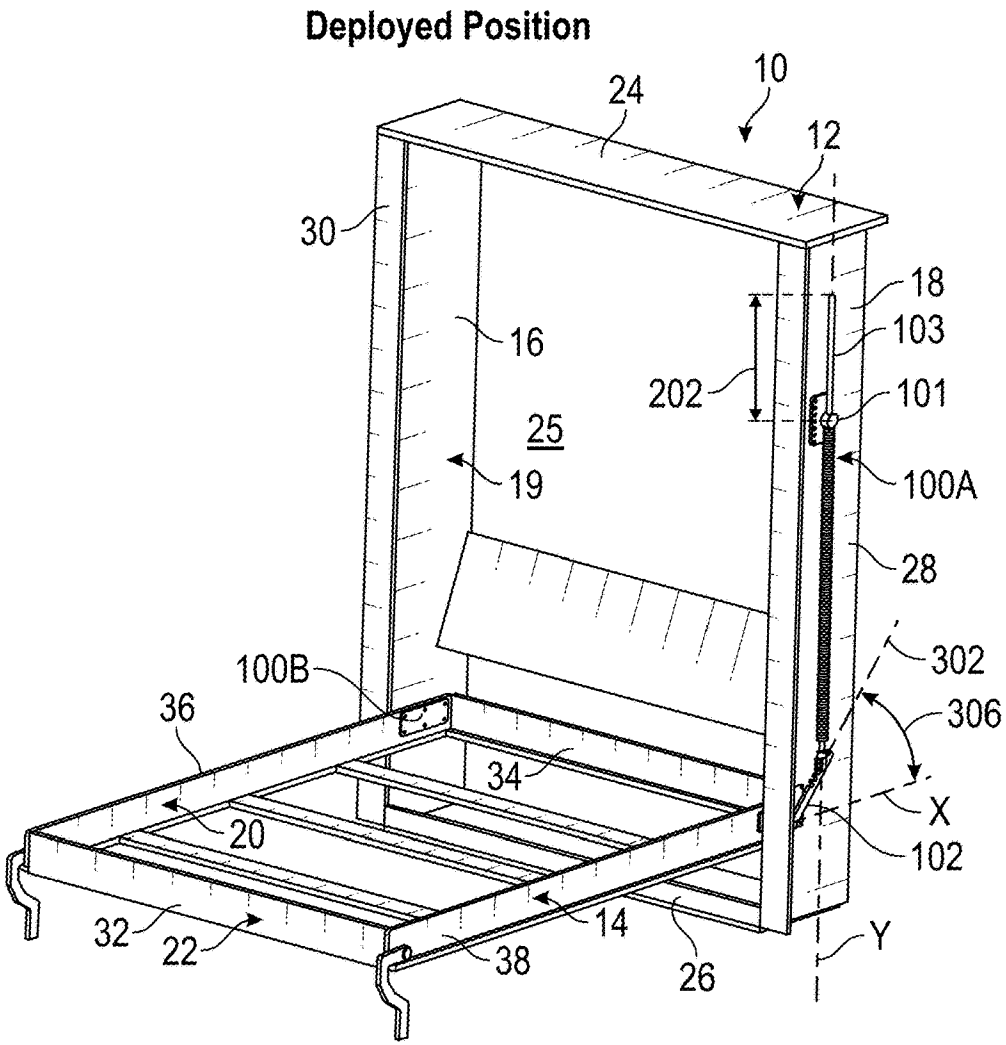
FIG. 2 is a perspective view of the embodiment of the wall bed of FIG. 1 showing the bed frame in the deployed position.

Various embodiments of a wall bed having at least one spring mechanism attached to a cabinet and bed frame for deploying and retracting the bed frame relative to the stationary cabinet are disclosed. In other embodiments, the spring mechanism may have other applications for deploying and retracting a pivoting frame relative to a stationary structural element. In some embodiments, a respective spring mechanism is secured to each opposite side of a vertically-mounted stationary cabinet of a wall bed as well as being secured to each respective opposite side of a bed frame for effecting deployment and retraction of the bed frame relative to the vertically-mounted stationary cabinet. In one aspect, each spring mechanism includes a pivoting lever arm operatively engaged to a piston rod and compression spring arrangement at one of a plurality of engagement points formed defined along the lever arm that produces a predetermined compressive spring force being applied against the lever arm when effecting deployment or retraction of the bed frame relative to the vertically mounted cabinet. In some embodiments of the spring mechanism, a plurality of arcuate-shaped coupling portions may be formed along the edge of the lever arm that each act as a respective engagement point for operatively coupling the piston rod and compression spring at a particular position along the lever arm for establishing a predetermined compressive spring force to be applied by the compression spring to the bed frame during deployment and/or retraction. In some embodiments, one or more spring mechanisms may be retrofitted into an existing wall bed or incorporated into a newly installed wall bed. Referring to the drawings, embodiments of an improved spring mechanism for a wall bed are illustrated and generally indicated as 100 in FIGS. 1-31.

Figure 1:
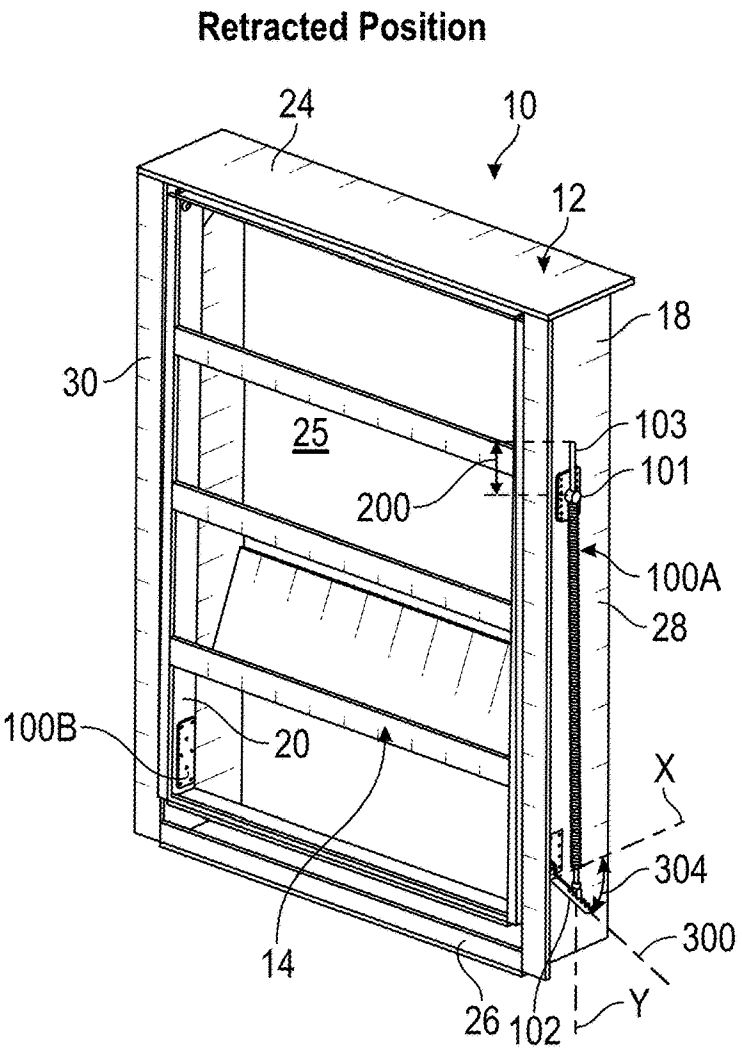
FIG. 1 is a perspective view of an embodiment of a wall bed showing first and second spring mechanisms attached to respective sides of a cabinet and bed frame shown in the retracted position.

As shown in FIGS. 1 and 2, in some embodiments the wall bed 10 includes first and second spring mechanisms 100A and 1008 mounted to respective opposite sides of a vertically-mounted stationary cabinet 12 and respective opposite sides of a bed frame 14 in order to deploy and retract the bed frame 14 in a pivoting action relative to the stationary cabinet 12. As shown, the cabinet 12 defines an interior surface 16 and an exterior surface 18 that collectively form a top panel 24, a bottom panel 26, a rear panel 25, a first side panel 28, and an opposite second side panel 30. As shown, the top panel 24, bottom panel 26, rear panel 25, and the first and second side panels 28 and 30 collectively define a recess 19 configured to receive the bed frame 14 therein when the wall bed 10 is in the retracted position shown in FIG. 1. The bed frame 14 defines an interior surface 20 and an exterior surface 22 that collectively define a front panel 32, rear panel 34, left side panel 36 and right side panel 38 configured to receive a mattress (not shown). The cabinet 12 and bed frame 14 are exemplary embodiments in which the first and second spring mechanisms 100A and 100B are operatively engaged to effect deployment or retraction of the bed frame 14; however, the first and second spring mechanisms 100A and 100B may be used with any type of pivoting structure that requires deployment from or retraction into a recess formed in a wall or stationary cabinet-type structure.

In one aspect, the components of the first and second spring mechanisms 100A and 100B are identical in construction, configuration and operation for deploying and retracting the bed frame 14. As shown, the first spring mechanism 100A is attached to the right side panel 38 of the bed frame 14 and the second side panel 28 of the cabinet 12, while the second spring mechanism 100B is attached to left side panel 36 of the bed frame 14 and the first side panel 30 of the cabinet 12. The compressive spring force applied by the first and second spring mechanisms 100A and 100B to the bed frame 14 may be set at a particular predetermined setting such that the bed frame 102 is deployed from retracted position A to a deployed position C, and vice versa, in a manner that accommodates the particular weight of mattress and bed spring combination in addition to the weight of the bed frame 14 during deployment and retraction. The bed frame 102 may be positioned at an equilibrium B position oriented along axis Z such that the weight of the bed frame 102 is substantially equal to the compressive spring force being applied by a compression spring 104 to retract the bed frame 102, thereby "suspending" the bed frame 102 between the retracted position A and deployed position C. For example, equilibrium point B may be achieved at an angle 310, e.g., about 30 degrees relative to deployed position C, or at an angle 308, e.g., about 60 degrees relative to the retracted position A. In some embodiments, either the first spring mechanism 100A or the second spring mechanism 100B, alone, may be used to deploy and retract the bed frame 14.

Figure 3A:
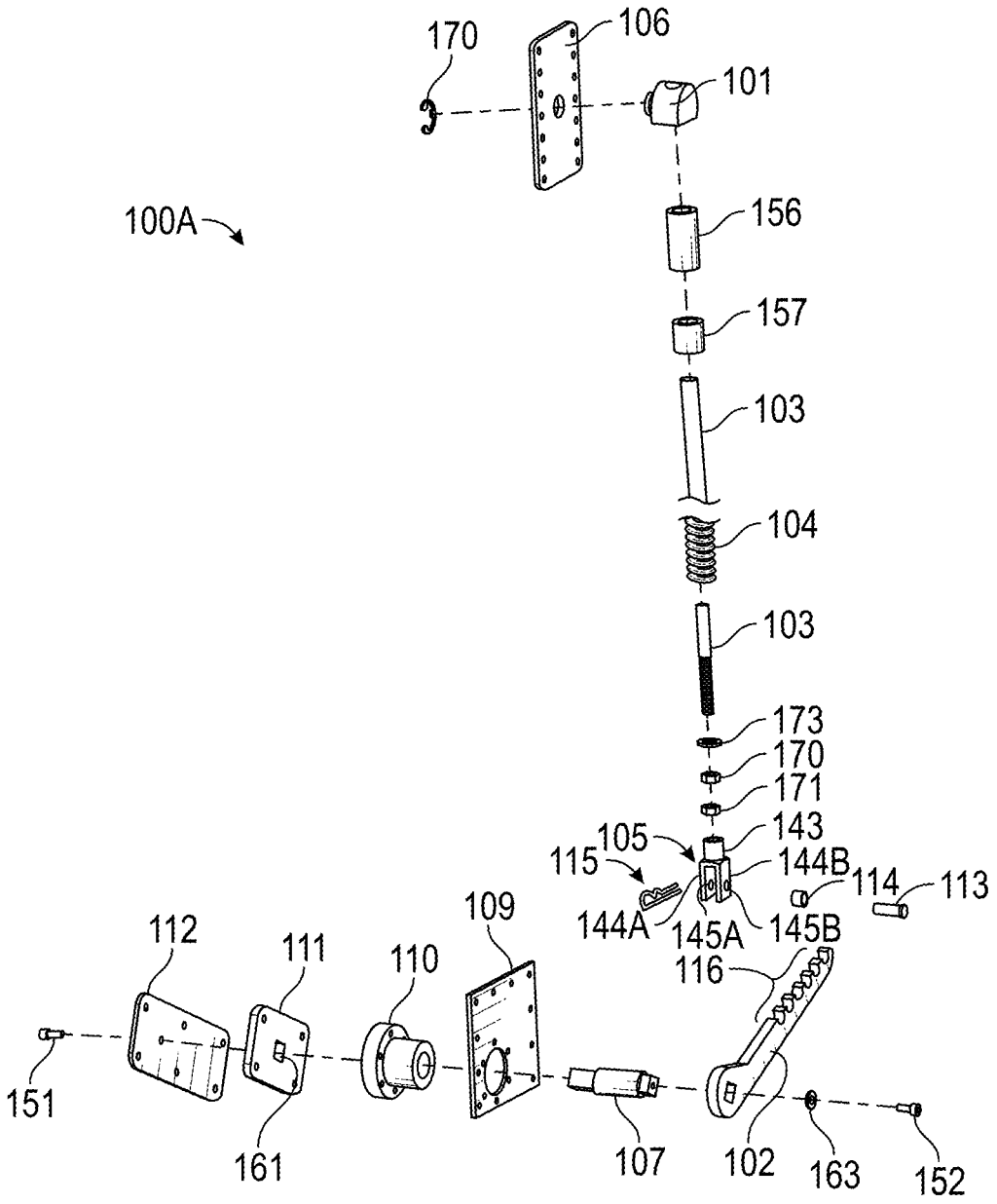
FIG. 3A is an exploded view of the first spring mechanism and FIG. 3B is an exploded view of the second spring mechanism.
Figure 3B:
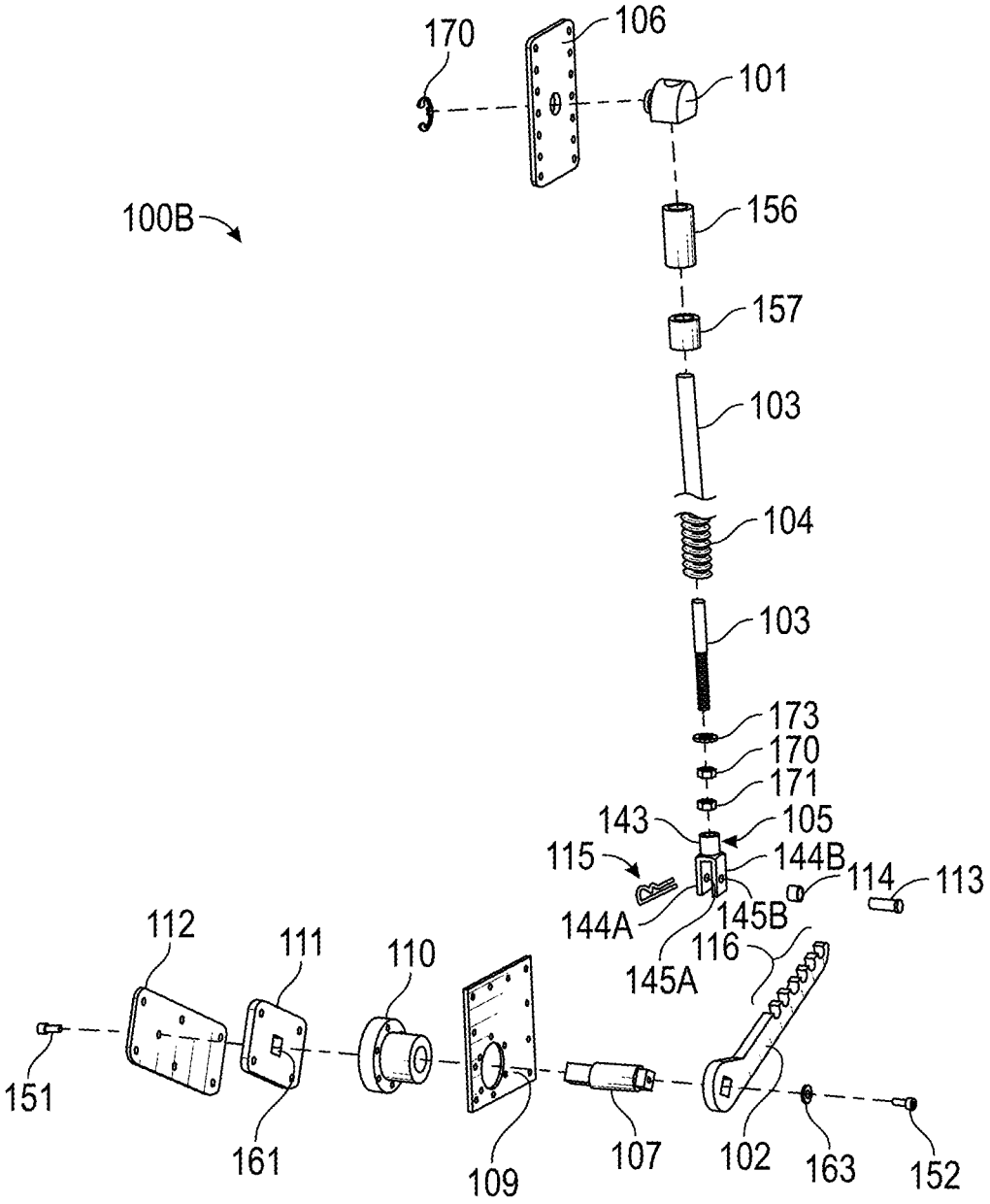

Referring to FIGS. 3A and 3B, in some embodiments the first and second spring mechanisms 100A and 100B each include a lever arm 102 coupled to a piston rod 103 through a clevis 105 that may be engaged at different lateral positions defined along the lever arm 102. In some embodiments, the clevis 105 defines a clevis body 143 defining a pair of laterally extending end portions 144A and 144B forming respective opposing channels 145A and 145B configured to receive a retaining ring 114. The retaining ring 114 is configured to receive a clevis pin 113 that secures the retaining ring 114 between the laterally extending end portions 144A and 144B. Once the clevis pin 113 is inserted through the laterally extending end portions 144A and 144B, a hairpin cotter pin 115 is coupled to the clevis pin 113 for securing the clevis 105 to the respective coupling portion of the lever arm 102.

Figure 20:
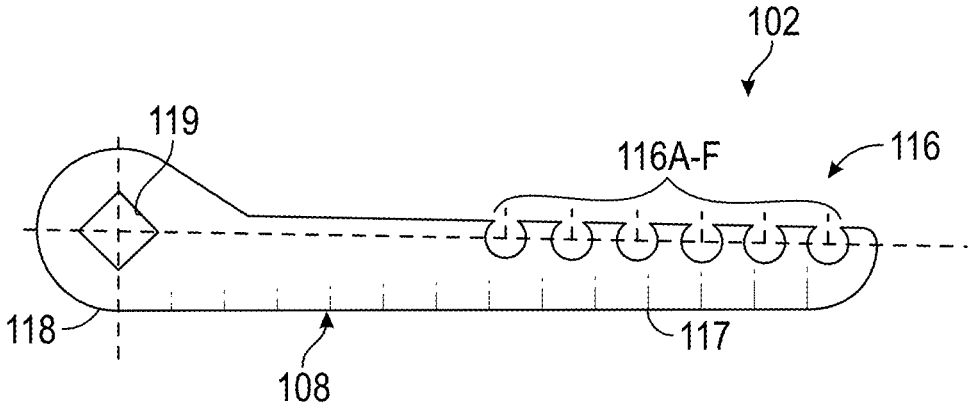
FIG. 20 is a side view showing a lever arm of the first and second spring mechanisms of FIGS. 3A and 3B, respectively.

As shown in FIG. 20, the lever arm 102 forms a lever arm body 108 defining a distal end portion 117 for coupling with the clevis 105 and proximal end portion 118 defining a square-shaped aperture 119 configured for engagement with a main axle rod 107 for permitting rotation of the lever arm 102 about a fulcrum established by the main axle rod 107. As further shown, a plurality of arcuate-shaped coupling portions 116 is formed along the edge of the distal end portion 117 of the lever arm 102, each of the coupling portions 116 being respective engagement points configured for coupling the clevis 105 to the lever arm 102 when setting a predetermined degree of compressive spring force to be generated by the compression spring 104 when the bed frame 14 is either being retracted or deployed. In some embodiments, the lever arm 102 may define six coupling portions 116A-116F arranged in an array along the edge of the lever arm 102 for establishing a predetermined degrees of compressive spring force by the compression spring 104 when the piston rod 103 is engaged to the lever arm 102 through the clevis 105.

Table 1 below provides a matrix of the various forces and settings for each of the six possible respective settings represented by coupling the piston rod 103 to one of the coupling portions 116A-116F of the lever arm 102. For example, Table 1 provides respective values for spring load force per setting, distance from load force to fulcrum, piston rod travel, distance of effort forcer (balance point) to fulcrum (main axle rod), rate of spring force, effort force (lift) per spring mechanism, and total bed frame weight possible. Although six coupling portions 116A-116F are illustrated, the lever arm 102 may define any plurality of coupling portions 116 at various positions for establishing various settings for establishing the compressive spring force applied by the compression spring 104 to the bed frame 14.

TABLE 1

| SETTINGS | ONE | TWO | THREE | FOUR | FIVE | SIX |
|---|---|---|---|---|---|---|
| Spring Load per Setting (lbs) | 226.61 | 263.93 | 301.26 | 338.58 | 375.91 | 413.23 |
| Distance from Load Force to Fulcrum (inches) | 6.00 | 7.00 | 8.00 | 9.00 | 10.00 | 11.00 |
| Divides Line 7 by appropriate Setting Number (inches) | 5.00 | 4.29 | 3.75 | 3.33 | 3.00 | 2.73 |
| Piston Rod Travel (inches) | 8.50 | 9.90 | 11.30 | 12.70 | 14.10 | 15.50 |
| Distance of Effort Force (balance Point) to Fulcrum (Axle) (inches) | 30.00 | 30.00 | 30.00 | 30.00 | 30.00 | 30.00 |
| Rate of Spring Force per inch/pound (inches/lbs) | 26.66 | 26.66 | 26.66 | 26.66 | 26.66 | 26.66 |
| Effort Force (lift) per first and second spring mechanism (lbs) | 45.32 | 61.58 | 80.34 | 101.57 | 125.30 | 151.52 |
| Effort Force (lift) first and second spring mechanisms together (lbs) | 90.64 | 123.17 | 160.67 | 203.15 | 250.60 | 303.04 |

Figure 6:
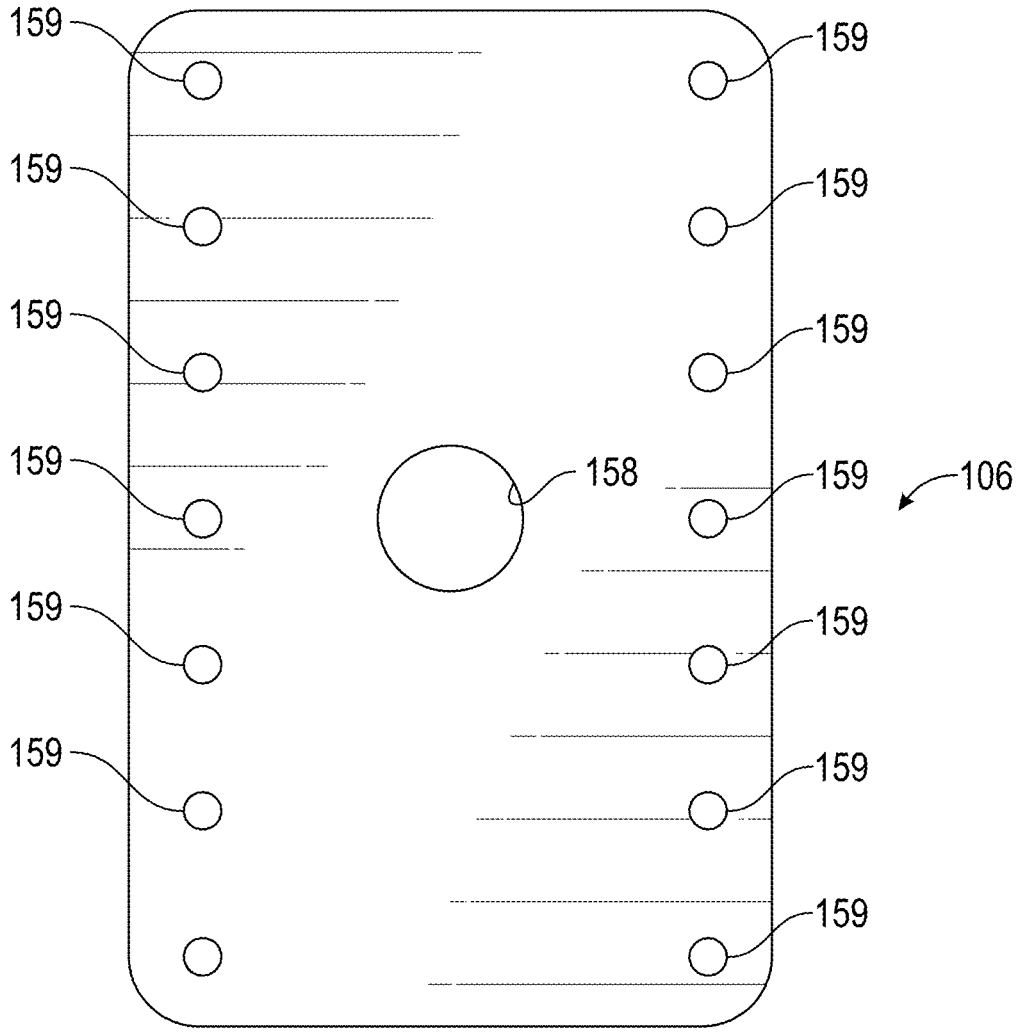
FIG. 6 is a top planar view showing a top plate of the first and second spring mechanisms of FIGS. 3A and 3B, respectively.
Figure 7:
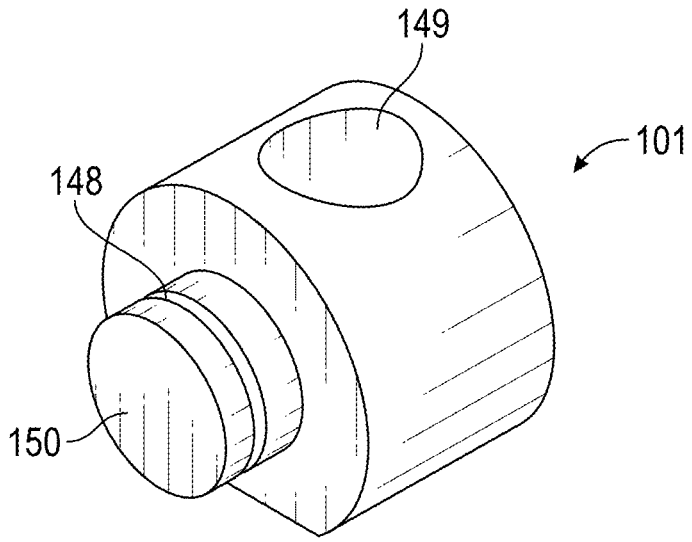
FIG. 7 is a perspective view showing a piston guide of the first and second spring mechanisms of FIGS. 3A and 3B, respectively.
Figure 8:
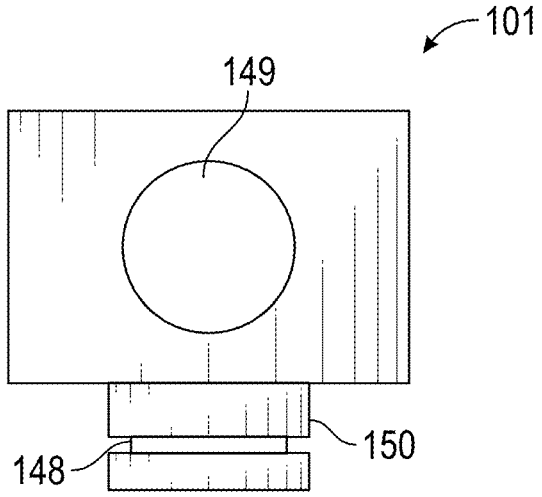
FIG. 8 is a side view of the piston guide of FIG. 7.
Figure 9:
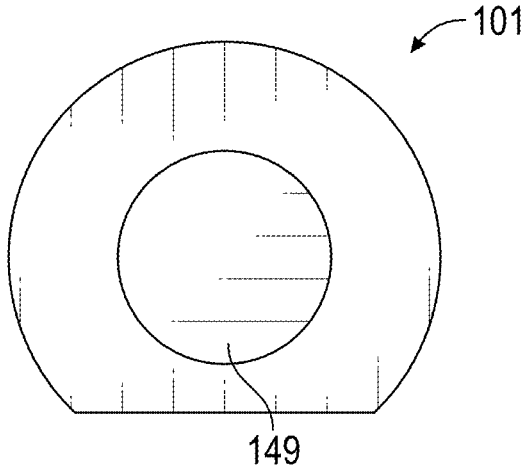
FIG. 9 is a top view of the piston guide of FIG. 7.
Figure 10:
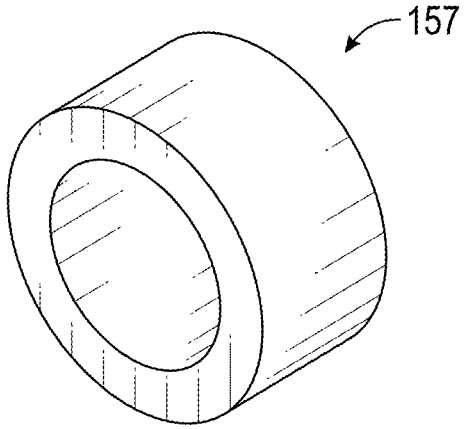
FIG. 10 is a perspective view showing a first adjuster of the first and second spring mechanisms of FIGS. 3A and 3B, respectively.
Figure 11:
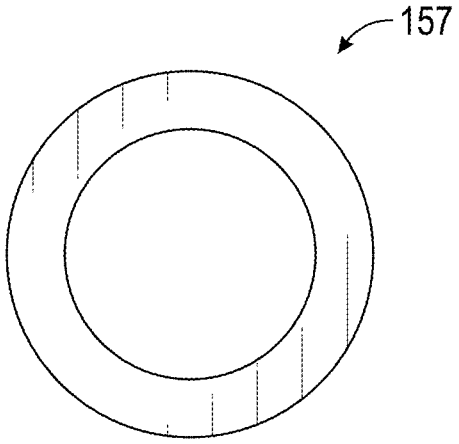
FIG. 11 is an end view of the first adjuster of FIG. 10.
Figure 12:
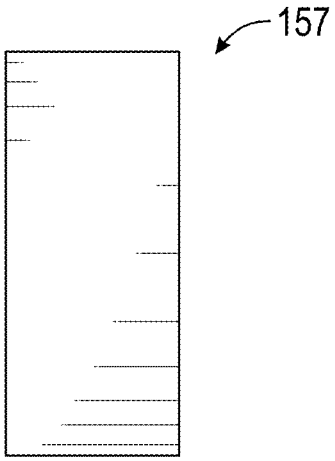
FIG. 12 is a side view of the first adjuster of FIG. 10.
Figure 13:
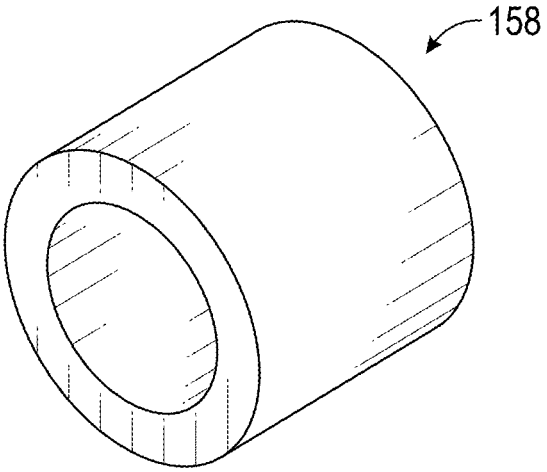
FIG. 13 is a perspective view showing a second adjuster of first and the second spring mechanisms of FIGS. 3A and 3B, respectively.
Figure 14:
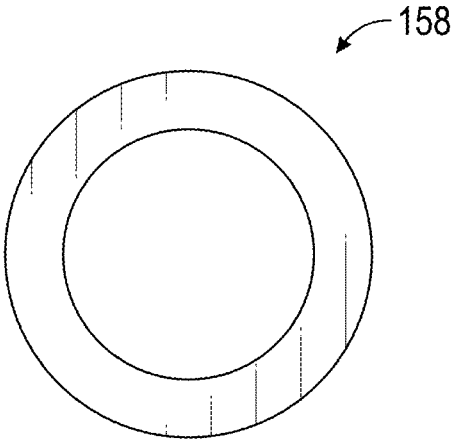
FIG. 14 is an end view of the second adjuster of FIG. 13.
Figure 15:
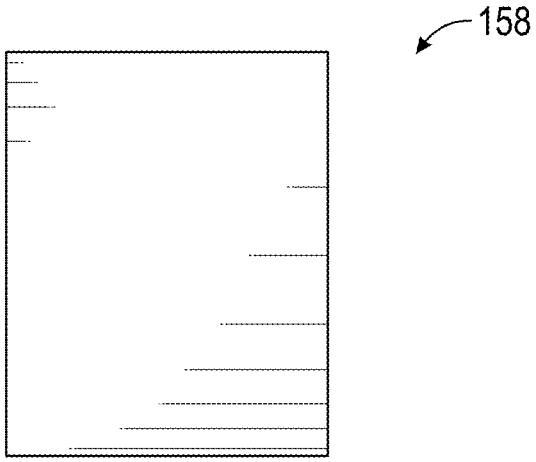
FIG. 15 is a side view of the second adjuster of FIG. 13.
Figure 16:
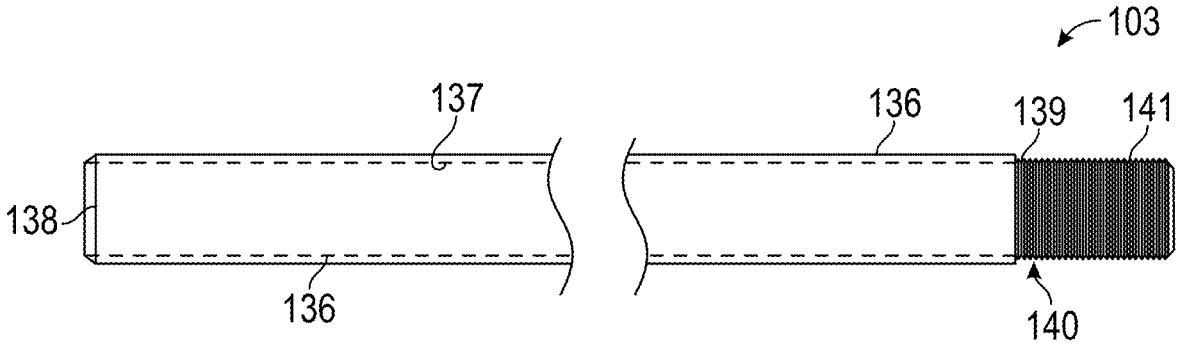
FIG. 16 is a side view showing a piston rod of the first and second spring mechanisms of FIGS. 3A and 3B, respectively.
Figure 17:
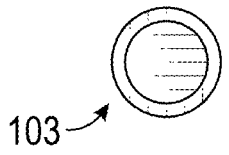
FIG. 17 is an end view of the piston rod of FIG. 16.
Figure 18:
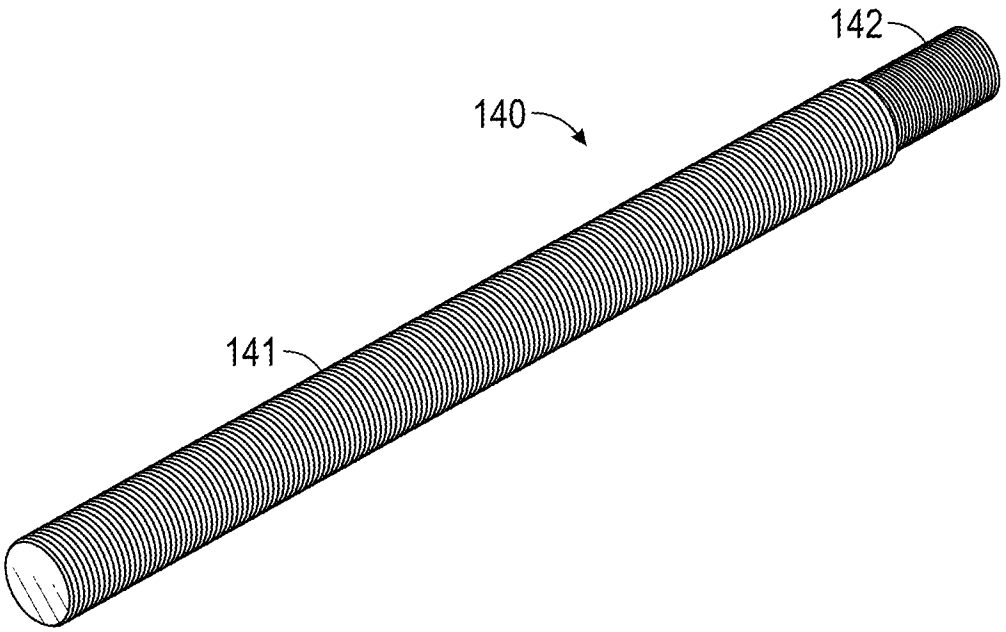
FIG. 18 is a perspective view showing an elongated threaded member of the piston rod of FIG. 16.
Figure 19:
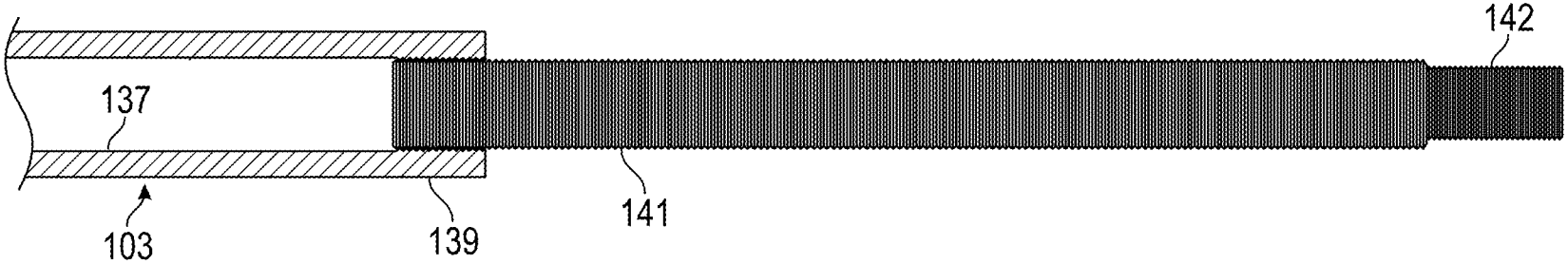
FIG. 19 is a side view of the elongated threaded member of FIG. 18.

Referring to FIGS. 1, 2, 3A, 3B, 7-9, and 16-19, the piston rod 103 is directly coupled to a piston guide 101 for guiding the travel of the piston rod 103 during deployment and retraction of the bed frame 14. In some embodiments, the piston guide 101 defines an axial channel 149 configured to allow passage of the piston rod 103 axially through the piston guide 101. In addition, the piston guide 101 defines a lateral extension 150 with an annular groove 148 configured to be inserted through a top plate 106 secured to the exterior surface 18 of the cabinet 12 as shown in FIGS. 1 and 2. Specifically, the lateral extension 150 of the piston guide 101 is configured to extend through a central opening 158 (FIG. 6) formed by the plate body 160 of the top plate 106 such that annular groove 148 of the lateral extension 150 is coupled to a retaining ring 113 for securing the piston guide 101 to the top plate 106. As shown in FIG. 6, the top plate 106 forms a plurality of apertures 159 along the periphery configured to receive a securing member (not shown), such as a screw, for securing the top plate 106 to the exterior surface 18 of the stationary cabinet 12. In some embodiments, the piston rod 103 may be coupled to either a long adjuster component 156 or a short adjuster component 158 as illustrated in FIGS. 3A and 3B that permits the piston rod 103 to be lengthened to one of two predetermined lengths when engaging the piston rod 103 to the piston guide 101.

As shown in FIGS. 16-19, the piston rod 103 forms an elongated body 136 that defines an axial channel 137 in communication with a proximal opening 138 and an opposite distal opening 139. The axial channel 137 is configured to receive an elongated threaded insert 140 disposed therein such that a threaded end portion 142 defined by the elongated threaded insert 140 extends outwardly from the distal opening 139. The threaded end portion 142 is configured to engage the piston rod 103 to either the long adjuster component 156 or the short adjuster component 157. In one aspect, the long and short adjuster components 156 and 157 also allow the top plate 106 to be mounted upward along the cabinet 12.

As shown in FIGS. 1-3, the lever arm 102 is engaged to a main axle rod 107 for mounting the proximal end portion 118 of the lever arm 102 to the bed frame 14. When assembled, the main axle rod 107 extends through a bottom plate 109 mounted to the exterior surface 18 of the cabinet 102 and extends through a main axle hub 110 engaged to the bottom plate 109 mounted on the interior surface 16 of the cabinet 12.

Figure 21:
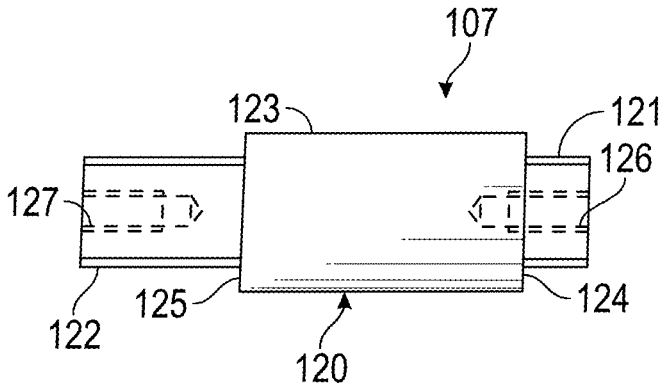
FIG. 21 is a side view showing a main axle rod of the first and second spring mechanisms of FIGS. 3A and 3B, respectively.
Figure 22:
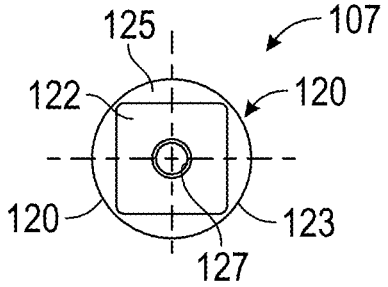
FIG. 22 is an end view of the main axle rod of FIG. 21.

Referring to FIGS. 21 and 22, as noted above, the main axle rod 107 is coupled to the lever arm 102 for providing a fulcrum (FIG. 4) in which the lever arm 102 pivots about. In some embodiments, the main axle rod 107 forms an axle rod body 120 defining a square-shaped proximal end portion 121 configured to be coupled to the lever arm 102 and a square-shaped-distal end portion 122 configured to be coupled to a main axle hub 110 for securing the main axle rod 107 to the cabinet 12 and bed frame 14, respectively. In addition, the axle rod body 121 defines a circular-shaped middle portion 123 formed between proximal end portion 121 and the distal end portion 122. The square-shaped proximal end portion 121 of the main axle rod 107 forms an annular shoulder 124 with the circular middle portion 123, while the square-shaped proximal end portion 121 forms an annular shoulder 125 with the opposite end of the circular middle portion 123. As shown in FIG. 21, a proximal channel 126 is defined through the square-shaped proximal portion 121 configured to receive proximal pan head 152 therein that, along with a washer 163, secures the lever arm 102 to the main axle rod 107. Similarly, a distal channel 127 is defined through the square-shaped distal portion 122 configured to receive a distal pan head 151 therein that secures the main axle rod 107 to the inner bed frame plate 112 which is engaged to the interior surface 20 of the bed frame 14.

Figure 25:
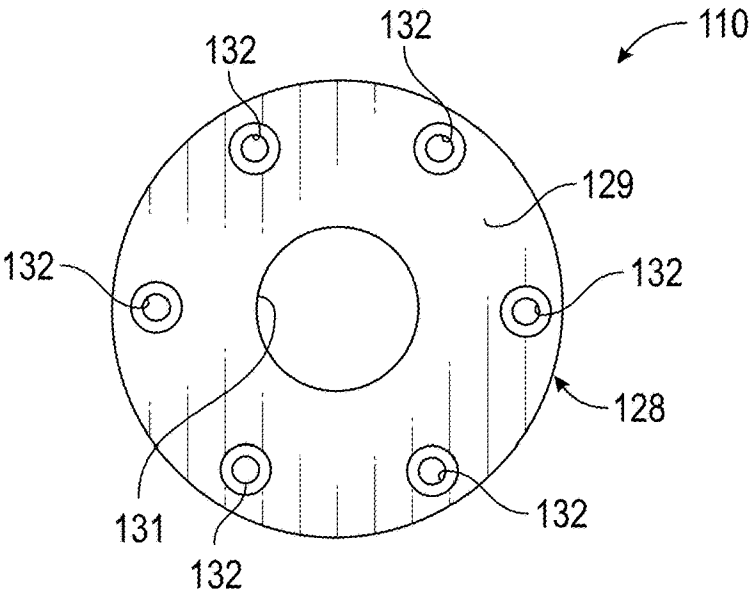
FIG. 25 is a rear view of the main axle hub of FIG. 23.
Figure 24:
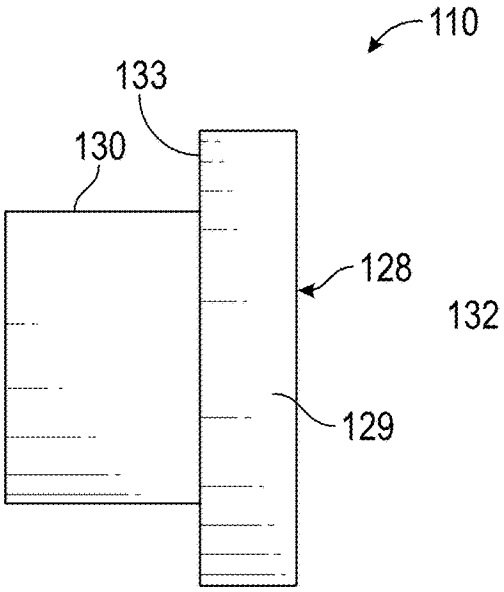
FIG. 24 is a side view of the main axle hub of FIG. 23.
Figure 23:
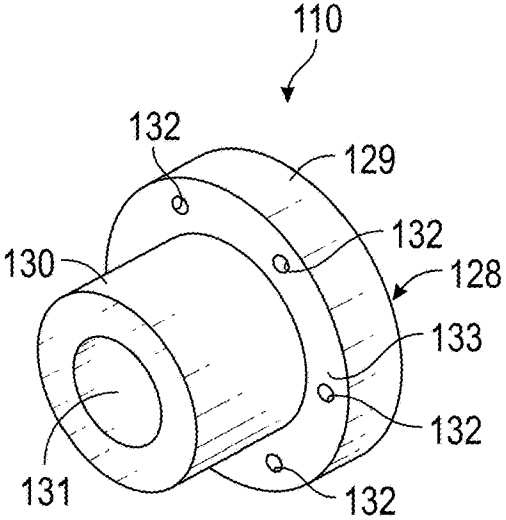
FIG. 23 is a perspective view showing a main axle hub of the first and second spring mechanisms of FIGS. 3A and 3B, respectively.
Figure 27:
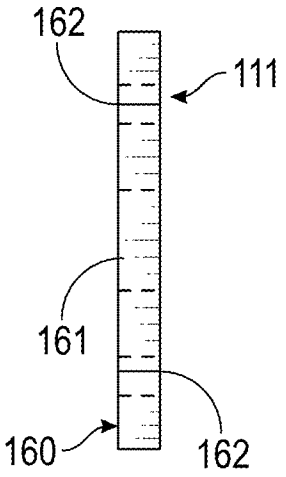
FIG. 27 is a side view of the outer bed frame plate of FIG. 26.
Figure 26:
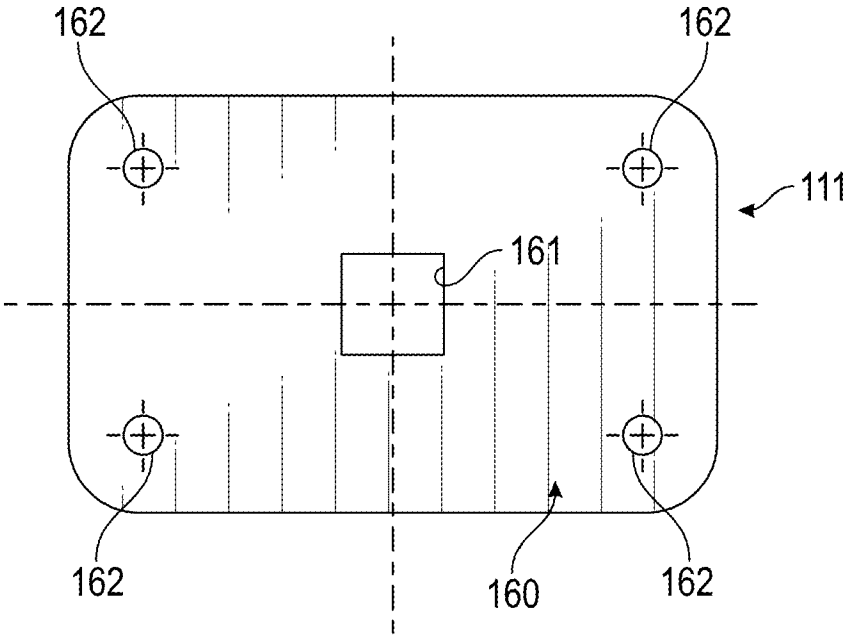
FIG. 26 is a planer top view showing an outer bed frame plate of the first and second spring mechanisms of FIGS. 3A and 3B, respectively.
Figure 29:
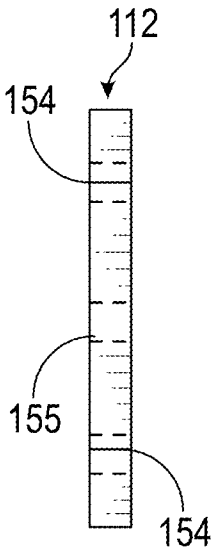
FIG. 29 is a side view of the inner bed frame plate of FIG. 28.
Figure 28:
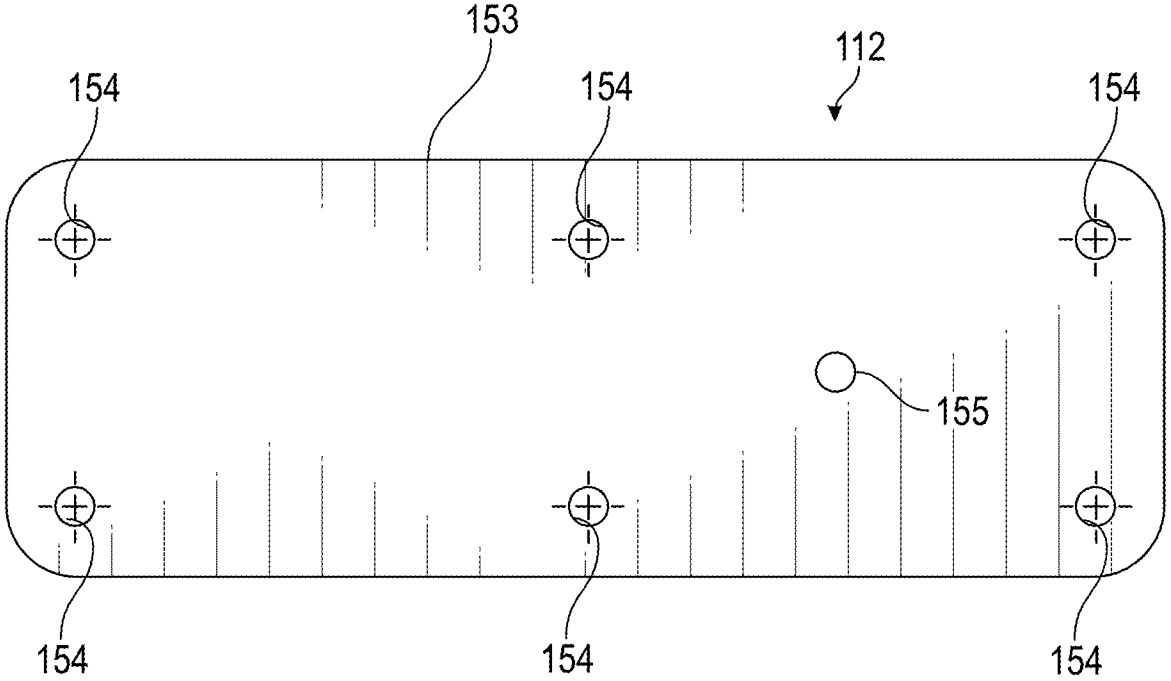
FIG. 28 is a planar top view showing an inner bed frame plate of the first and second spring mechanisms of FIGS. 3A and 3B, respectively.

Referring to FIGS. 23-25, the main axle hub 110 forms a main axle hub body 128 defining a base portion 129 and axially extending hub portion 130. The base portion 129 and hub portion 130 collectively define an axial channel 131 configured to receive the main axle rod 107. In some embodiments, a plurality of apertures 132 are formed concentrically around the base portion 129 configured to receive securing members (not shown) to secure the main axle hub 110 to the interior surface 16 of the cabinet 12 such that the hub portion 129 extends through the bed frame 14 when engaged to the main axle rod 107.

Referring to FIGS. 1, 2, 26 and 27, an outer bed frame plate 111 is secured to the exterior surface 22 of the bed frame 14 and coupled to the inner bed frame plate 112. As shown, the outer bed frame plate 111 defines a plurality of apertures 162 configured to receive a respective securing member (not shown) for securing the outer bed frame plate 111 to the bed frame 14. In addition, the outer bed frame plate 111 defines a central opening 161 configured to receive the distal end portion 122 of the main axle rod 107 during assembly that permits access to the distal channel 127 for engagement with a distal pan head 151 such that the main axle rod 107 becomes securely coupled to the outer bed frame plate 111, the inner bed frame plate 112 and the bed frame 14.

Referring to FIGS. 1, 2, 28 and 29, the inner bed frame plate 112 defines a plate body 153 that defines a plurality of apertures 154 configured to receive a respective securing member (not shown) to secure the inner bed frame plate 112 to the exterior surface 22 of the bed frame 14. In addition, the plate body 153 defines an opening 155 that communicates with the central opening 161 of the outer bed frame plate 111 when assembled such that the distal pan head extends through both openings 155 and 161 to secure the distal pan head 151 to the distal channel 127 of the main axle rod 107.

Referring back to FIGS. 3A and 3B, the bottom plate 109 is secured to the exterior surface 18 of the cabinet 12 and defines a circular hub opening 134 configured to receive the hub portion 130 of the main axle hub 110 when coupling the bottom plate 109 to the main axle hub 110. In addition, the bottom plate defines a plurality of apertures 132 along the periphery of the bottom plate 109 which are configured to receive securing members (not show) to secure the bottom plate 109 to the cabinet 12.

Figure 5:
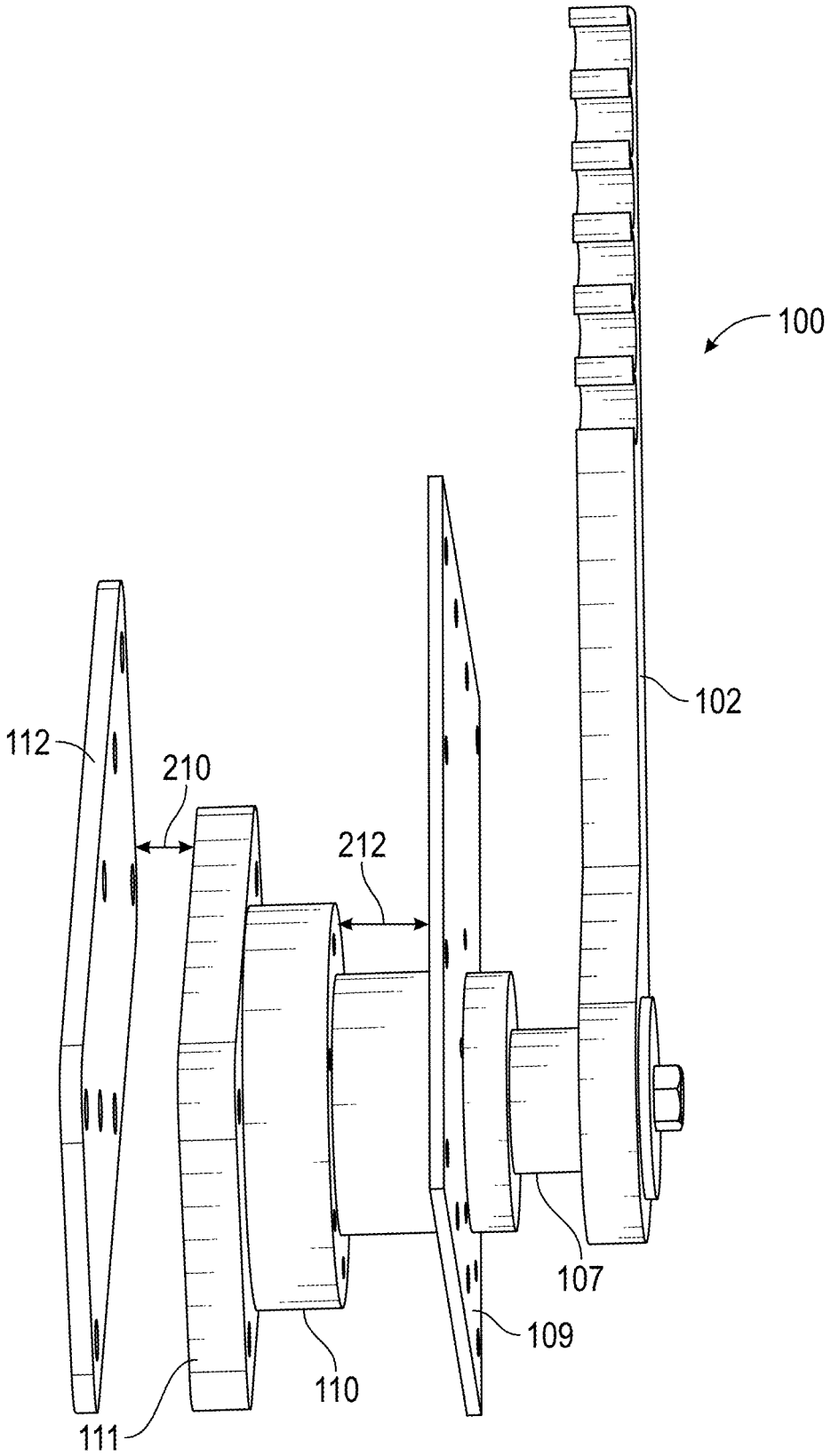
FIG. 5 is a perspective view of the first spring mechanism shown in an assembled state with the inner bed frame plate spaced apart to illustrate the distance required to accommodate the bed frame.

As shown in FIG. 5, the assembly of the main axle 107, bottom plate 109, main axle hub 110, and the outer bed frame plate 111 with the inner bed frame plate 112 spaced apart to illustrate the distance 210 required to accommodate the width of the bed frame plate 14. The distance 212 represents the length required to accommodate the width of the first and second side panels 28 and 30 of the cabinet 12.

Figure 30:
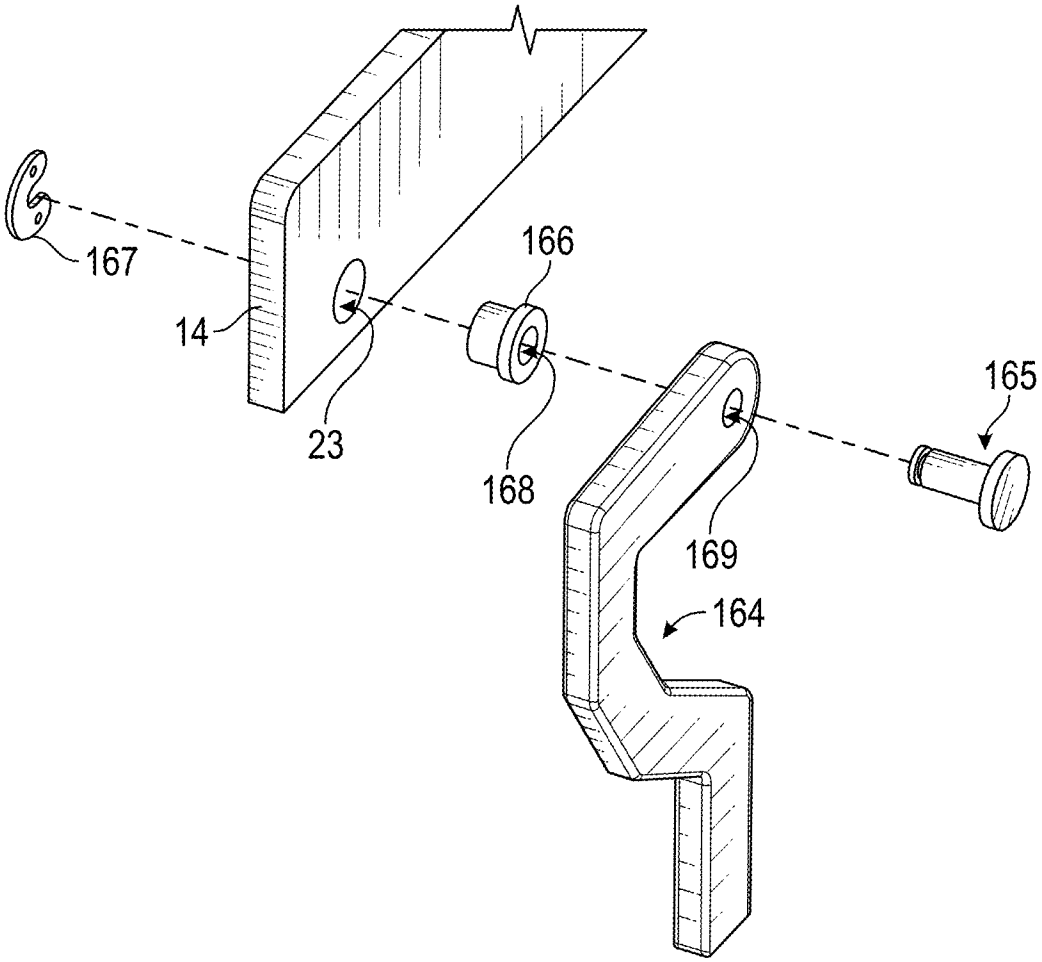
FIG. 30 is an exploded view of a leg support assembly shown in FIG. 1.

Referring to FIG. 30, in some embodiments the wall bed 10 includes a pair of leg supports 164 secured to opposite sides of the bed frame 14 for supporting the bed frame 14 when the wall bed 10 is in the deployed position. As shown, each leg support 164 defines a leg support opening 169 configured to receive a respective leg axle 165 such that the leg axle 165 extends through the leg support opening 169 and may be engaged to a leg hub 166. The leg hub 166 is configured to be received within a respective channel 23 formed through the left and right side panels 36 and 38 of the bed frame 14. In addition, each leg hub 166 defines a channel 168 configured to receive a respective leg axle 165 such that the free end of the leg axle 165 extends through the leg hub 166, thereby permitting a leg axle clip 167 to be engaged to the leg axle 165 and collectively engage together the assembled leg support 164, leg axle 165, and leg hub 166 to form a leg support assembly for the bed frame 14.

In one aspect, as noted above the distal and proximal pan heads 151 and 152 are engaged to opposite ends of the main axle rod 107 and are used to adjust the position of the bed frame 14 laterally left or right.

Figure 4:
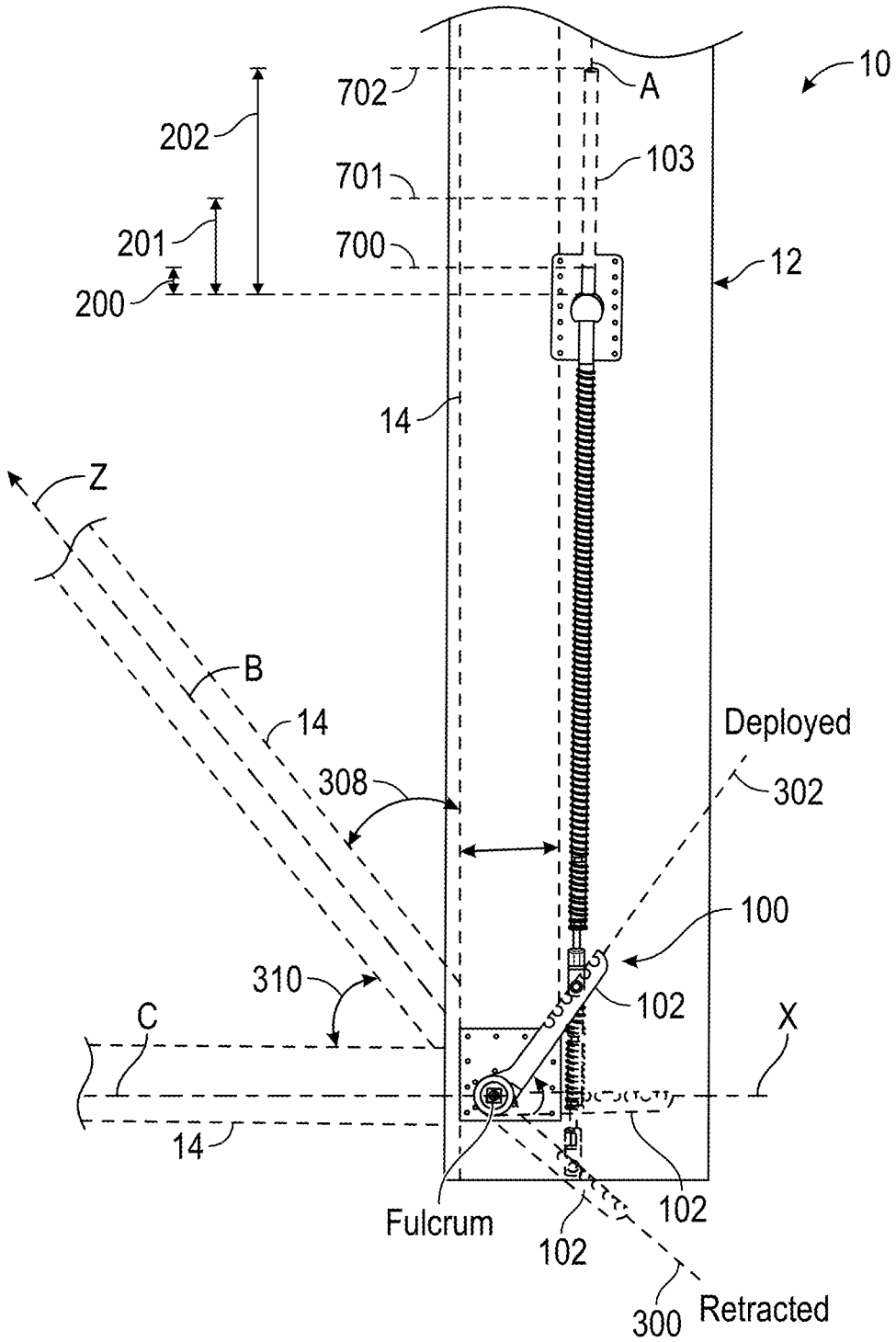
FIG. 4 is a side view of the wall bed of FIGS. 1 and 2 showing the sequence of deployment or retraction of the bed frame from the cabinet between an end point A (retracted position), a balance point B (balanced position), and an end point C (deployed position).

After the first and second spring mechanisms 100A and 1008 are attached to the stationary cabinet 12 and bed frame 14, the a user couples the clevis 105 of each piston rod 103 to one of the coupling portions 116A-116F of each lever arm 102 in order to set the compressive spring force setting for each compression spring 104 to accommodate the particular bed frame 14 being deployed and retracted. As shown in FIG. 1, when the first and second spring mechanisms 100A and 1008 are in the retracted position with the bed frame 14 disposed within the recess of the cabinet 12, each lever arm 102 is oriented along an axis 300 such that an angle 304 is formed between axis 300 of the lever arm 102 and an X axis of the wall bed 10. In this position, each piston rod 103 extends a first distance 200 relative to the height of the piston guide 101. Referring to FIGS. 2 and 4, as the bed frame 14 is being deployed by the weight of the bed frame 14 in combination with the user pulling down or up the bed frame 14 from and to the cabinet 12 acting against the compressive spring force applied by the compression spring 104 causes the bed frame 14 to pivot from the retracted position (FIG. 1) which rotates the lever arm 102 in a counter clockwise direction such that the bed frame 14 assumes the deployed position. When the bed frame 14 is fully deployed, each lever arm 102 is oriented along axis 302 such that an obtuse angle 306 is formed between axis 302 and the X axis of the wall bed 10. In this position, each piston rod 103 extends a second distance 202 relative to the height of the piston guide 101 when the bed frame 14 is deployed and a first distance 200 when the bed frame 14 is deployed. Conversely, when the bed frame 14 is retracted from the deployed position the lever arm 102 rotates in a clockwise direction until each lever arm 102 is oriented again along axis 300 and forms an angle 304 between axis 300 and the X-axis. As shown in FIG. 4, when the bed frame 14 is in the deployed position, the piston rod 103 reaches level 702 and when the bed frame 14 is in the retracted position, the piston rod 103 is lowered to level 700. When the bed frame 14 is in the balanced position the piston rod 103 reaches an intermediate level 701 having an intermediate distance 201 and the lever arm 102 is rotated along the X-axis.

Figure 31:
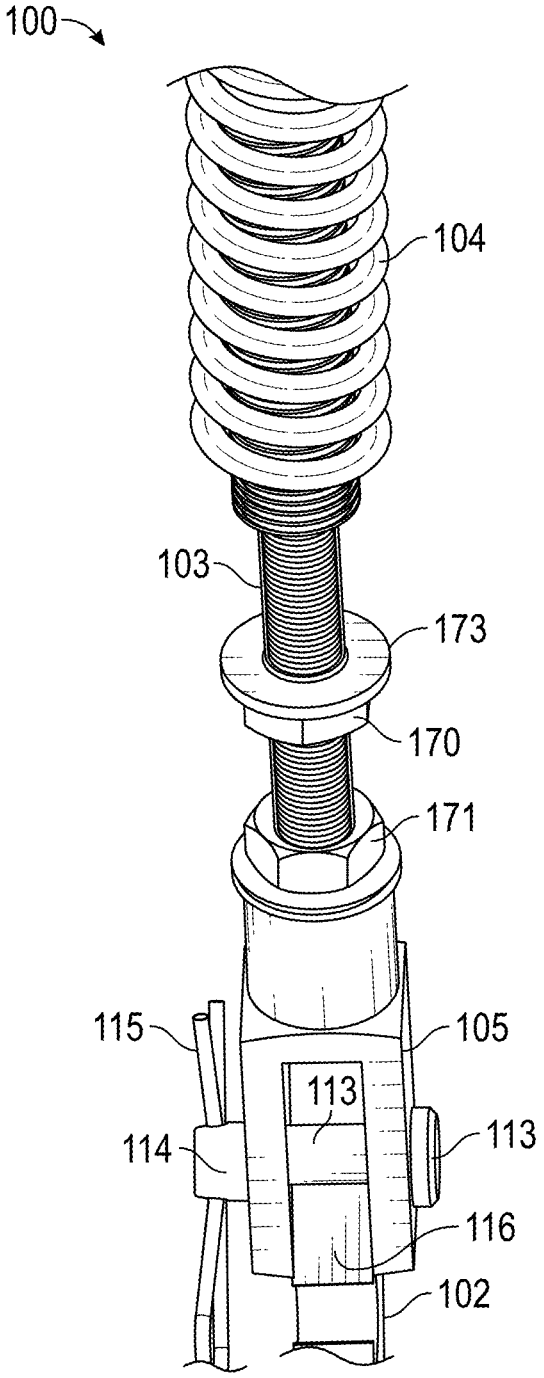
FIG. 31 is an enlarged perspective view of the first spring mechanism of FIG. 1.

Referring to FIG. 31, the effective length pf the piston rod 103 may be adjusted by rotating the adjustment nut 170 in contact with a washer 173 relative to a stationary nut 171 after the clevis 105 is coupled to the lever arm 102.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A spring mechanism comprising:

a piston rod in operative engagement with a compression spring;

a lever arm defining a distal portion and a proximal portion, the distal portion of the lever arm defining a plurality of coupling portions defined along the lever arm and each of the plurality of coupling portions being configured for respective engagement with the piston rod to establish a respective predetermined degree of compressive spring force generated by the compression spring, wherein operative engagement of the piston rod to one of the plurality of coupling portions along the lever arm establishes the predetermined degree of compressive spring force produced by the compression spring;

a piston guide defining a channel configured to allow passage of the piston rod through the piston guide;

a top plate engaged to the piston guide, the top plate being configured to mount the piston guide to a stationary structure;

a main axle rod engaged to the proximal portion of the lever arm for mounting the lever arm to a frame pivotally engaged to the stationary structure, the main axle rod allowing for rotation of the lever arm relative to the pivoting frame when the pivoting frame moves between a retracted position and a deployed position.

2. The spring mechanism of claim 1, further comprising:

a clevis coupled to the piston rod, the clevis being configured to be engaged to one of the plurality of coupling portions defined along the lever arm, wherein the clevis comprises a retaining ring engaged to a clevis pin for securing the piston rod to the lever arm along one of the plurality of coupling portions.

3. The spring mechanism of claim 1, further comprising:

a plate arrangement comprises an inner plate configured for engagement with an interior side of the pivoting frame and an outer plate configured for engagement with an exterior side of the pivoting frame.

4. The spring mechanism of claim 1, wherein the compression spring surrounds the piston rod and applies a compressive spring force to the lever arm that acts on the pivoting frame.

5. The spring mechanism of claim 1, wherein the plurality of coupling portions is arranged in a linear array along the edge of the lever arm.

6. The spring mechanism of claim 2, wherein each of the plurality of coupling portions defines an arcuate-shaped engagement point configured to engage the clevis.

7. The spring mechanism of claim 1, wherein a bottom plate defines an opening configured to allow passage of the main axle rod for mounting the lever arm to the stationary structure.

8. The spring mechanism of claim 1, further comprising:

a main axle hub defining a hub portion and a base portion, and further defining an axial channel configured to receive the main axle rod.

9. The spring mechanism of claim 1, further comprising:

a leg support assembly comprising a first leg support mounted along one side of the pivoting frame and a second leg support mounted along an opposite side of the pivoting frame.

10. The spring mechanism of claim 1, for comprising:

an adjuster component configured to be coupled to the piston rod for adjusting the height of the piston rod.

11. The spring mechanism of claim 1, wherein the lever arm is rotatable between the retracted position and the deployed position for deploying and retracting the pivoting frame, respectively.

12. The spring mechanism of claim 1, a bottom plate engaged to the main axle rod for mounting the lever arm to the frame.

13. A wall bed comprising:

a stationary cabinet forming an interior surface and an exterior surface that collectively form a recess;

a bed frame pivotally engaged to the stationary cabinet and configured to be retracted within the recess of the stationary cabinet; and at least one spring mechanism operatively engaged between the stationary cabinet and the bed frame, the at least one spring mechanism being operable for pivoting the bed frame relative to the stationary cabinet between a retraction position and a deployed position, the at least one spring mechanism comprises:

a piston rod in operative engagement with a compression spring;

a lever arm defining a distal portion and a proximal portion, the distal portion of the lever arm defining a plurality of coupling portions defined along the lever arm and each of the plurality of coupling portions being configured for respective engagement with the piston rod to establish a respective predetermined degree of compressive spring force generated by the compression spring, wherein operative engagement of the piston rod to one of the plurality of coupling portions along the lever arm establishes the predetermined degree of compressive spring force produced by the compression spring;

a piston guide defining a channel configured to allow passage of the piston rod through the piston guide;

a top plate engaged to the piston guide, the top plate being configured to mount the piston guide to the stationary cabinet; and a main axle rod engaged to the proximal portion of the lever arm for mounting the lever arm to the bed frame pivotally engaged to the stationary cabinet, the main axle rod allowing for rotation of the lever arm relative to the bed frame when the bed frame moves between the retracted position and the deployed position.

14. The wall bed of claim 13, wherein the at least one spring mechanism further comprising a clevis coupled to the piston rod, the clevis being configured to be engaged to one of the plurality of coupling portions defined along the lever arm, wherein the clevis comprises a retaining ring engaged to a clevis pin for securing the piston rod to the lever arm along one of the plurality of coupling portions.

15. A method of manually adjusting the degree of compressive spring force in a spring mechanism comprising:

providing a spring mechanism operatively engaged between a stationary structure and a pivoting frame, the spring mechanism being operable for pivoting the pivoting frame relative to the stationary structure between a retraction position and a deployed position, the spring mechanism comprises:

a piston rod in operative engagement with a compression spring;

a lever arm defining a distal portion and a proximal portion, the distal portion of the lever arm defining a plurality of coupling portions defined along the lever arm and each of the plurality of coupling portions being configured for respective engagement with the piston rod to establish a respective predetermined degree of compressive spring force generated by the compression spring, wherein operative engagement of the piston rod to one of the plurality of coupling portions along the lever arm establishes the predetermined degree of compressive spring force produced by the compression spring;

a piston guide defining a channel configured to allow passage of the piston rod through the piston guide;

a top plate engaged to the piston guide, the top plate being configured to mount the piston guide to the stationary structure;

a main axle rod engaged to the proximal portion of the lever arm for mounting the lever arm to the frame pivotally engaged to the stationary structure, the main axle rod allowing for rotation of the lever arm relative to the pivoting frame when the pivoting frame moves between a retracted position and a deployed position disengaging the piston rod from one of the plurality of coupling portions of the lever arm set at one of a predetermined degree of compressive spring force; and engaging the piston rod to another one of the plurality of coupling portions of the lever arm for establishing another one of a predetermined degree of compressive spring force.

* * * * *